US005749792A

United States Patent [19]

Engfer et al.

[11] Patent Number: 5,749,792

[45] Date of Patent: May 12, 1998

[54] GOLF CLUB HANDLE OVERSIZE GRIP KIT

[76] Inventors: Jeffrey R. Engfer, 859 Littleton Rd., Parsippany, N.J. 07054; Michael J. Britton, 14 Osage Dr., W. Milford, N.J. 07480

[21] Appl. No.: 705,987

[22] Filed: Aug. 30, 1996

[51] Int. Cl.[6] ..... A63B 57/00

[52] U.S. Cl. ..... 473/300

[58] Field of Search ..... 473/300, 301, 473/302, 303, 287, 288, 289, 290, 291

[56] References Cited

U.S. PATENT DOCUMENTS

| | | | |
|---|---|---|---|
| 2,133,695 | 10/1938 | Hall . | |
| 2,520,808 | 8/1950 | Miller . | |
| 3,072,955 | 1/1963 | Mitchell . | |
| 3,087,729 | 4/1963 | Sullivan | 473/301 |
| 3,606,326 | 9/1971 | Sparks et al. | 473/300 |
| 3,614,100 | 10/1971 | Spitz . | |
| 5,316,299 | 5/1994 | Feche et al. | 473/300 |

FOREIGN PATENT DOCUMENTS

| | | | |
|---|---|---|---|
| 1356971 | 6/1974 | United Kingdom | 473/300 |

*Primary Examiner*—William H. Grieb
*Attorney, Agent, or Firm*—Terrance L. Siemens

[57] ABSTRACT

Auxiliary golf club grips, preferably provided as a set of varied sizes, for providing oversized gripping surfaces. Each grip comprises a capped sleeve preferably having a wall of linearly variable thickness. The wall is thickest and the external diameter of the sleeve is greatest at the capped end. The other end of the sleeve is open so that the sleeve may be slipped over a golf club. Internal cavities of all individual grips of the set are identical, and cooperate with handles of standard golf clubs. Preferably, the cap and open end of the sleeve are rounded. A preferred constituent material is a resilient, elastic, foamed synthetic resin.

6 Claims, 2 Drawing Sheets

GOLF CLUB HANDLE OVERSIZE GRIP KIT

BACKGROUND OF THE INVENTION

1. Field of the Invention

The present invention relates to covers for handles of golf clubs. More particularly, the invention comprises a set of covers of diverse sizes encompassing progressively increasing external diameter. Each cover is a sleeve formed from a resilient or elastic material. The cover is slipped over the grip of the handle of a golf club, thereby providing an oversized grip for a standard golf club handle. The invention comprises a plurality of covers for increasing likelihood that a suitable cover will be available to persons preferring oversized grips.

2. Description of the Prior Art

Golf clubs are impact devices which are swung through an arc to impart momentum to a stationary ball. The ball is struck in order to carry a potentially considerable distance towards a target. The ratio of diameter of the ball to the distance to the target is quite great. Therefore, in addition to being able to strike the ball a considerable distance, there is the further requirement that the ball be struck with accuracy. Since most golf courses incorporate obstacles, the golfer must select an indirect path to bypass these obstacles.

A golf swing is therefore subject to two conflicting demands, those of power and accuracy. Even small deviations in the initial trajectory can lead to competitive disadvantages as a consequence. Therefore, every effort must be made to control accuracy of the swing, as well as to impart considerable force to the ball.

A crucial aspect of the golf club is the ease of grasping. Golf clubs are manufactured to an industry standard regarding diameter of the grip provided for grasping the club. This grip may be suitable for some golfers but not others. Also, the grip may be suitable in some circumstances, but unsuitable in others, even to the same person.

The prior art has suggested auxiliary grips in the form of sleeves, for improved grasp of a handle. In the field of golf clubs, U.S. Pat. No. 2,133,695, issued to Eric E. Hall on Oct. 18, 1938, shows flexible or resilient sleeves which are to be placed around the shafts of golf clubs. Hall allows for the possibility of providing one end of the auxiliary grip to be of increased diameter, but does not specify how this is to be achieved. In contrast to Hall, the present invention sets forth details of the specific construction resulting in increased diameter of the novel cover at one end. Also, Hall fails to teach a group of grips, each having different dimensions from the others.

An auxiliary grip for slipping over a handle of an implement shown in U.S. Pat. No. 2,520,808, issued to Robert J. Miller on Aug. 29, 1950, features variable wall thickness. However, the internal cavity of Miller's cover varies in diameter, the outer diameter of the grip being of constant diameter. By contrast, in the present invention, inner diameter is not critical, being designed to conform to the handle of a golf club. However, the outer diameter varies by being tapered to influence gripping characteristics. Therefore, the outer diameter of the grips of the present invention varies, being greatest at the closed top end of the grip. Again, Miller does not provide a plurality of grips wherein each is of different dimensions or sizes compared to the others, as seen in the present invention.

Resilient auxiliary grips are further illustrated in U.S. Pat. Nos. 3,606,326, issued to William J. Sparks et al. on Sep. 20, 1971, and 3,614,100, issued to Harvey D. Spitz on Oct. 19, 1971. Sparks et al. suggest various compositions of foamed synthetic resins which would have suitable resilience and elasticity. Spitz addresses the role of perspiration in effectiveness of grip of a handle. Both Sparks et al. and Spits do not address dimensional characteristics of their respective covers, as occurs in the present invention. Neither Sparks et al nor Spitz teaches a plurality of grips of different sizes, as seen in the present invention.

None of the above inventions and patents, taken either singly or in combination, is seen to describe the instant invention as claimed.

SUMMARY OF THE INVENTION

The present invention provides a kit of a plurality of oversized auxiliary grips for standard golf clubs. Each grip comprises an annular sleeve preferably capped or closed at one end. The grip is to be slipped over a handle of a golf club.

Wall thickness of the sleeve varies so the effective outer diameter of each grip is increased over the diameter of the handle of a standard golf club. The closed end of the grip is of greater diameter than is the open end thereof. Preferably, taper is continuous and gradual, to avoid a step or other discernible structure which could distract a golfer. Diameter of the interior or cavity of the sleeve is selected to conform to standard golf clubs.

A preferred material is foamed synthetic resin, or any material having elasticity, resilience, and frictional characteristics equivalent to foamed synthetic resins. It is desired that the grip deform under the user's grasp, but still offer some resistance to deformation. This allows the grip to conform to the user's hand, thereby providing maximal surface area contacting the hand. At the same time, by avoiding characteristics of rigidity and smoothness, the effort required of a user to grasp the club effectively is minimized. This avoids requiring that the club be tightly grasped, which both detracts from a person's ability to control a golf club swing with maximal precision, and also hastens fatigue.

Each grip has different wall thickness, compared to other grips. Objects having diameters greater than similar objects of lesser diameter are more easily grasped than are the latter. Thus, the present invention provides a group or kit of auxiliary grips which both improve effectiveness of grip and also provide a selection of sizes or dimensions enabling precise adjustment for each user and each golf club. This increases likelihood of finding a grip which closely meets the preferences of different individuals, or preferences for specific golf clubs within a set.

Accordingly, it is a principal object of the invention to provide an oversized auxiliary grip for the handle of a golf club, which increases the exterior diameter of the handle.

It is another object of the invention that the auxiliary grip be elastic and resilient.

It is a further object of the invention that the auxiliary grip conform to the handle of the golf club and also to a user's hand.

Still another object of the invention is to provide a group or plurality of auxiliary grips as a kit, so that an appropriate grip may be selected and installed on a golf club.

An additional object of the invention is that the auxilary grip be gradually and continuously tapered.

It is again an object of the invention that the auxiliary grip be of greater outside diameter at the capped end of the grip, and of lesser diameter at the open end.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
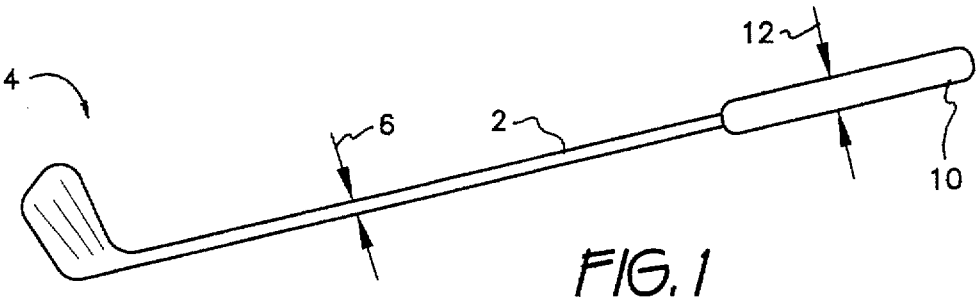
FIG. 1 is a perspective, environmental view of an auxiliary grip according the invention, shown installed on a golf club.

Turning now to FIG. 1 of the drawings, an auxiliary grip 10 is shown installed on the handle 2 of a conventional, standard golf club 4. Auxiliary grip 10 is oversized compared to handle 2. This signifies that the outer diameter of auxiliary grip 10, indicated at 12, is of greater magnitude than that of a corresponding outer diameter, indicated at 6, of handle 2.

Installation of auxiliary grip 10 is easily performed by drawing auxiliary grip 10 over handle 2 until the end (not shown) of handle 2 abuts the closed end of auxiliary grip 10. Auxiliary grip 10 is fabricated from a resilient, elastic material, such as a foamed synthetic resin. Auxiliary grip 10 is dimensioned and configured to cooperate closely with handle 2 of club 4, so that once installed, it is retained on handle 2 by friction.

Figure 2:
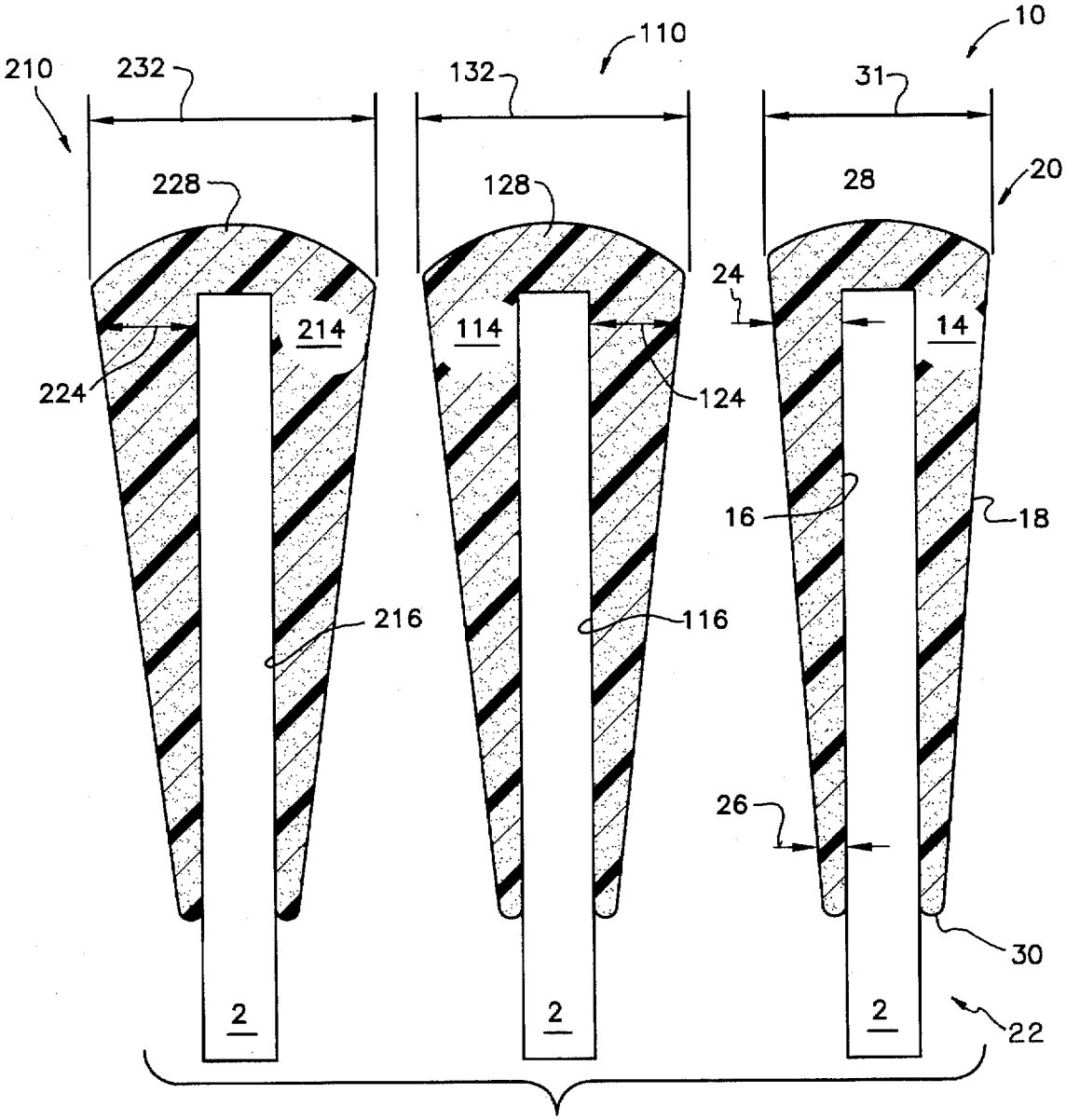
FIG. 2 is a cross sectional view of three diferent sizes of novel auxiliary grips.

FIG. 2 illustrates construction of auxilary grip 10 and related auxiliary grips 110, 210. Although not easily discerned in FIG. 1, auxiliary grip 10 is tapered. This is better seen in the exaggerated view of FIG. 2. First considering auxiliary grip 10, each grip 10, 110, or 210 comprises a sleeve having a circumferential wall 14, 114, and 214, respectively.

Wall 14 defines an internal cavity 16 cooperating with handle 2 of golf club 4. Wall 14 also has a linearly, continuously tapered external surface 18. That is, thickness of wall 14 varies at a constant rate from its thickest point at proximal end 20 of grip 10 to its thinnest point at distal end 22 of grip 10. This is apparent from examining the thickness dimension of wall 14 at 24, and comparing this thickness to that seen at 26.

Auxiliary grip 10 also has a rounded cap 28 closing proximal end 20. As seen in FIG. 2, cap 28 is integral with wall 14. Distal end 22 is open to admit passage of handle 2 of golf club 4. The bottom surface 30 of wall 14 is also rounded. Rounding avoids creases, discernible edges, and similar structure which would possibly distract a golfer. Constant or linear taper of wall 14 also provides this benefit.

FIG. 2 illustrates three auxiliary grips 10, 110, 210. Each grip 10, 110, or 210 has a circumferential wall 14, 114, or 214 defining a cavity 16, 116, or 216 therein, and a rounded cap 28, 128, and 228. Cavities 16, 116, and 216 are identical. However, walls 14, 114, and 214 differ among themselves in that each grip 10, 110, or 210 has an outside diameter 32, 132, or 232 of magnitude different from that of every other auxiliary grip 10, 110, or 210. Since cavities 16, 116, and 216 are identical, it follows that wall thickness must vary among grips 10. This relationship is seen when comparing wall thickness of grip 10 at 24, wall thickness of grip 110 at 124, and wall thickness of grip 210 at 224.

Figure 3:
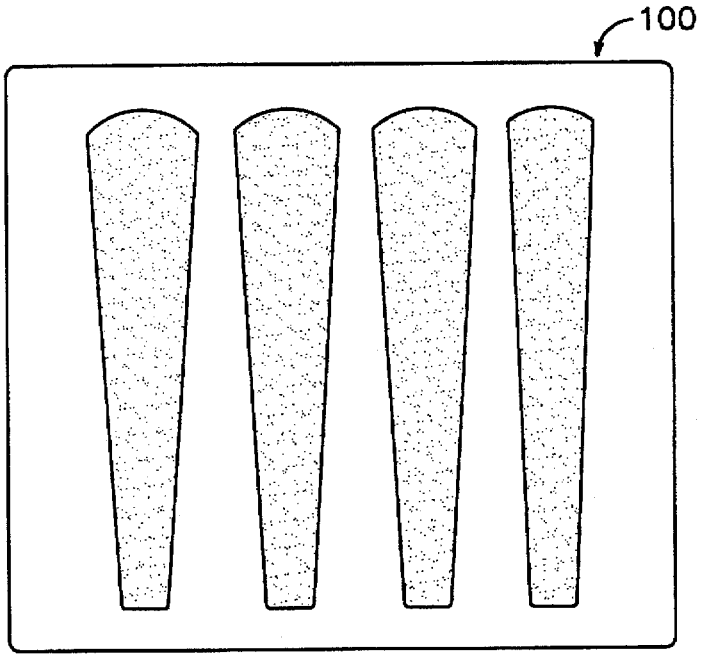
FIG. 3 is a top view of a kit containing four associated auxiliary grips.

Auxiliary grips such as 10, 110, and 210 collectively form a kit of auxiliary grips for golf clubs which are interchangeable and readily installed on and removed from conventional, standard golf clubs. FIG. 3 shows such a kit with four various sized grips arranged in a box 100 for sale as a unit. The kit offers a golfer adjustability or selectivity of oversizing of a golf club handle 2 for improved grasp thereof.

The novel kit offers an individual golfer a variety of sizes or dimensions, so that different irons or golf clubs may be improved, or more closely matched to the golfer's hands, to a different degree, to accommodate different circumstances. Alternatively, the kit may provide several different golfers each an appropriate oversized auxiliary grip.

Figure 4:
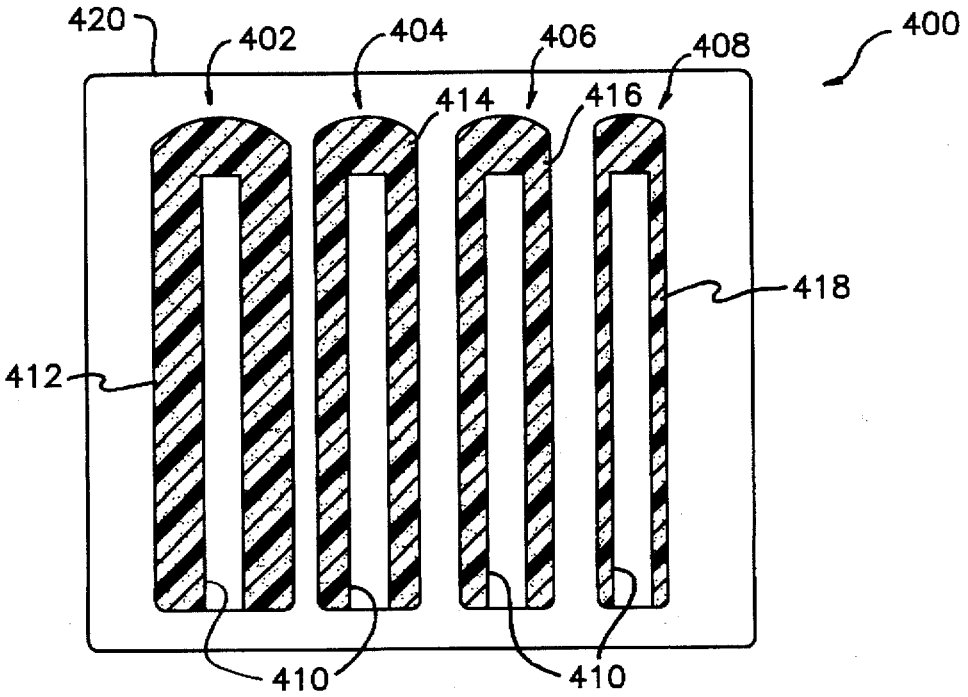
FIG. 4 is a top view of a kit containing four associated auxiliary grips, according to an alternative embodiment.

FIG. 4 illustrates a generally similar kit 400, including grips 402, 404, 406, and 408 each having internal cavities 410 of similar dimensions. Grips 402, 404, 406, and 408 differ from one another in that their respective walls 412, 414, 416, and 418 are of different thicknesses and therefore of different overall exterior diameters. However, the outside surfaces of grips 402, 404, 406, and 408 are all cylindrical, unlike the outside surfaces of the grips of the prior embodiments. Grips 402, 404, 406, and 408 are enclosed within a box or package 420 for sale or other distribution to the public.

It is to be understood that the present invention is not limited to the embodiments described above, but encompasses any and all embodiments within the scope of the following claims.

We claim:

1. A kit of auxiliary grips for golf clubs, comprising a plurality of auxiliary grips each comprising a sleeve having a circumferential wall having an internal cavity cooperating with the handle of the golf club and a linearly and continuously tapered external surface, a proximal end and a distal end, and an integral cap closing said proximal end, said distal end being open, said circumferential wall being of variable thickness, said circumferential wall having a first thickness dimension at said proximal end of said circumferential wall and a second thickness dimension at said distal end of said circumferential wall, said first thickness dimension being of greater magnitude than that of said second thickness dimension, each one said auxiliary grip having an outside diameter of magnitude different from every other one said auxiliary grip, said cavity of each said auxiliary grip being identical to said auxiliary grip of every other said auxiliary grip; and an enclosure enclosing said plurality of auxiliary grips.

2. The auxiliary grip according to claim 1, said sleeve formed from a resilient and elastic foamed synthetic resin.

3. The auxiliary grip according to claim 1, said cap being rounded and said distal end of said sleeve being rounded, whereby said sleeve is unencumbered by sharp edges and creases.

4. A kit of auxiliary grips for golf clubs, comprising a plurality of auxiliary grips each comprising a sleeve having a circumferential wall having an internal cavity cooperating with the handle of the golf club and an external surface, a proximal end and a distal end, and an integral cap closing said proximal end, said distal end being open, each one said auxiliary grip having an outside diameter of magnitude different from every other one said auxiliary grip, said cavity of each said auxiliary grip being identical to said auxiliary grip of every other said auxiliary grip; and an enclosure enclosing said plurality of auxiliary grips.

5. The auxiliary grip according to claim 4, said sleeve formed from a resilient and elastic foamed synthetic resin.

6. The auxiliary grip according to claim 4, said cap being rounded and said distal end of said sleeve being rounded, whereby said sleeve is unencumbered by sharp edges and creases.

* * * * *